US010391774B2

(12) United States Patent
Shirono et al.

(10) Patent No.: US 10,391,774 B2
(45) Date of Patent: Aug. 27, 2019

(54) TANK ARRANGEABLE IN LIQUID CONSUMING APPARATUS

(71) Applicant: BROTHER KOGYO KABUSHIKI KAISHA, Nagoya-shi, Aichi-ken (JP)

(72) Inventors: Taichi Shirono, Nagoya (JP); Masako Kawagoe, Nagoya (JP); Yoshinori Osakabe, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/988,331

(22) Filed: May 24, 2018

(65) Prior Publication Data

US 2018/0345673 A1 Dec. 6, 2018

(30) Foreign Application Priority Data

May 31, 2017 (JP) ..... 2017-108474

(51) Int. Cl.

| | |
|---|---|
| ***B41J 2/175*** | (2006.01) |
| ***B41J 2/17*** | (2006.01) |
| ***B41J 29/13*** | (2006.01) |

(52) U.S. Cl.

CPC ..... *B41J 2/1721* (2013.01); *B41J 2/1752* (2013.01); *B41J 2/17506* (2013.01); *B41J 2/17509* (2013.01); *B41J 2/17513* (2013.01); *B41J 2/17523* (2013.01); *B41J 2/17553* (2013.01); *B41J 2/17566* (2013.01); *B41J 29/13* (2013.01)

(58) Field of Classification Search

CPC ..... B41J 2/17513; B41J 2/17523; B41J 2/17553; B41J 2/17503; B41J 2/175; B41J 2/17509

USPC ..... 347/84–87

See application file for complete search history.

(56) References Cited

U.S. PATENT DOCUMENTS

| | | | | |
|---|---|---|---|---|
| 2003/0142176 | A1* | 7/2003 | Wu | B41J 2/175 347/85 |
| 2005/0270347 | A1* | 12/2005 | Yamamoto | B41J 2/17513 347/86 |
| 2011/0069126 | A1* | 3/2011 | Feng | B41J 2/17513 347/87 |
| 2012/0038719 | A1* | 2/2012 | Shimizu | B41J 2/17523 347/86 |
| 2012/0005693 | A1 | 3/2012 | Ishizawa et al. | |
| 2012/0056938 | A1 | 3/2012 | Ishizawa et al. | |

(Continued)

FOREIGN PATENT DOCUMENTS

JP 2012-51306 A 3/2012

*Primary Examiner* — An H Do

(74) *Attorney, Agent, or Firm* — Merchant & Gould P.C.

(57) ABSTRACT

There is provided a tank including: a liquid storing chamber; a first wall which expands in a first direction parallel to a horizontal direction and via which a liquid stored in the liquid storing chamber is visible from outside of the liquid storing chamber; a second wall formed with a supply port located above the first wall; a third wall defining a bottom of the liquid storing chamber; and a fourth wall arranged in the liquid storing chamber. A first gap is formed between one of the first and second walls and at least a part of a first end in the first direction, of the fourth wall, located closely to the one of the first and second walls; and a second gap is formed between the third wall and at least a part of a second end in the first direction, of the fourth wall, located closely to the third wall.

12 Claims, 12 Drawing Sheets

(56) References Cited

U.S. PATENT DOCUMENTS

| | | | | |
|---|---|---|---|---|
| 2014/0104349 | A1* | 4/2014 | Kimura | B41J 2/17509 347/85 |
| 2015/0049144 | A1* | 2/2015 | Aoki | B41J 2/17506 347/85 |
| 2015/0109378 | A1* | 4/2015 | Koike | B41J 2/175 347/85 |
| 2016/0009100 | A1* | 1/2016 | Kudo | B41J 2/17553 347/92 |
| 2016/0052286 | A1* | 2/2016 | Kimura | B41J 2/17509 347/86 |
| 2016/0089893 | A1* | 3/2016 | Osakabe | B41J 2/17513 347/85 |
| 2016/0121615 | A1* | 5/2016 | Igarashi | B41J 2/175 347/85 |
| 2016/0207338 | A1* | 7/2016 | Honoki | B41J 29/38 |
| 2016/0214393 | A1* | 7/2016 | Matsui | B41J 2/17566 |
| 2017/0274663 | A1* | 9/2017 | Kanaya | B41J 2/175 |
| 2018/0170063 | A1* | 6/2018 | Watanabe | B41J 2/175 |

* cited by examiner

TANK ARRANGEABLE IN LIQUID CONSUMING APPARATUS

CROSS REFERENCE TO RELATED APPLICATION

The present application claims priority from Japanese Patent Application No. 2017-108474 filed on May 31, 2017, the disclosures of which are incorporated herein by reference in its entirety.

BACKGROUND

Field of the Invention

The present teaching relates to a tank which is to be arranged in a liquid consuming apparatus and which is configured such that a liquid can be replenished to the tank via a supply port.

Description of the Related Art

There is known a printer provided with a tank which is configured such that the ink can be supplemented to the tank. In a case that the ink inside the tank is consumed, a user can supplement the ink stored in a bottle to the tank via a supply port of the tank.

Generally, the tank of such a printer is provided with a view wall (visible wall or visual confirmation wall). The view wall is a translucent or semi-translucent wall for allowing the user to confirm, from the outside of the tank, an ink remaining amount of the ink stored in the tank. The view wall is formed of a material which has a transparency or translucency to light to such an extent that the inside of the tank is visible from the outside of the tank.

In a case that the ink is supplemented to the inside of the tank from the supply port, the supplemented ink makes contact with a liquid surface of the ink stored in the tank, thereby ruffling or generating wave in the ink inside the tank, which in turn leads to such a fear that the ruffled ink (waved ink) might adhere to a location, in the inner surface of the view wall, which is positioned above an actual liquid surface of the ink. This consequently gives rise to such a problem that it is difficult for the user to correctly grasp the liquid surface of the ink stored in the tank.

The present teaching has been made in view of the above-described situation, and an object of the present teaching is to provide a structure, in a tank to which a liquid can be supplemented, for making it possible to reduce the reaching of the ruffling of the liquid, generated in the tank when the liquid is supplemented to the tank, to the view wall.

SUMMARY

According to an aspect of the present teaching, there is provided a tank including: a liquid storing chamber which is configured to store liquid to be consumed in a liquid consuming apparatus; a first wall expanding in a first direction parallel to a horizontal direction and in a direction having a vector component in an up-down direction, the liquid stored in the liquid storing chamber being visible, through the first wall, from outside of the liquid storing chamber; a second wall including a supply port located above the first wall and being configured to supply the liquid to the liquid storing chamber therethrough; a third wall defining a bottom of the liquid storing chamber; and a fourth wall arranged in the liquid storing chamber. A first gap is formed between one of the first and second walls and at least a part of a first end in the first direction, of the fourth wall, which is located closely to the one of the first and second walls; and a second gap is formed between the third wall and at least a part of a second end in the first direction, of the fourth wall, which is located closely to the third wall.

In a case that the liquid is supplied to the liquid storing chamber from the supply port, a major portion of the liquid is not located firstly in a space, in the liquid storing chamber, which is sandwiched between the first and fourth walls (hereinafter referred to as a "first space"); rather, the major portion of the liquid is located firstly in a space, in the liquid storing chamber, which is located on the opposite side to the first wall relative to the fourth wall (hereinafter referred to as a "second space"). Then, the liquid enters, into the first space form the second space, via the second gap from a lower side of the first space.

In a case that the liquid enters into the second space from the supply port and that the liquid falls on the liquid surface of the liquid already stored in the second space, the liquid surface is waved. In the above-described configuration, since the fourth wall extends toward the third wall, it is possible to reduce, by the fourth wall, the reaching of the wave, generated in the liquid surface when the liquid is supplemented to the ink tank, at the first space. As a result, it is possible to reduce the reaching of the wave of the liquid, generated in the inside of the tank when the liquid is supplemented to the tank, to the first wall.

The first gap allows the air to circulate between the first and second spaces. Accordingly, even in such a case that the liquid surface of the liquid supplied to the liquid storing chamber is raised to thereby fill the second gap with the liquid, the liquid can be further supplied to the first space.

BRIEF DESCRIPTION OF THE DRAWINGS

FIGS. 1A and 1B are perspective views each depicting the outer appearance of a multi-function peripheral 10, wherein FIG. 1A depicts a state that a cover 70 is at a closed position, and FIG. 1B depicts a state that the cover 70 is at an opened position.

DESCRIPTION OF THE EMBODIMENTS

Figure 1A:
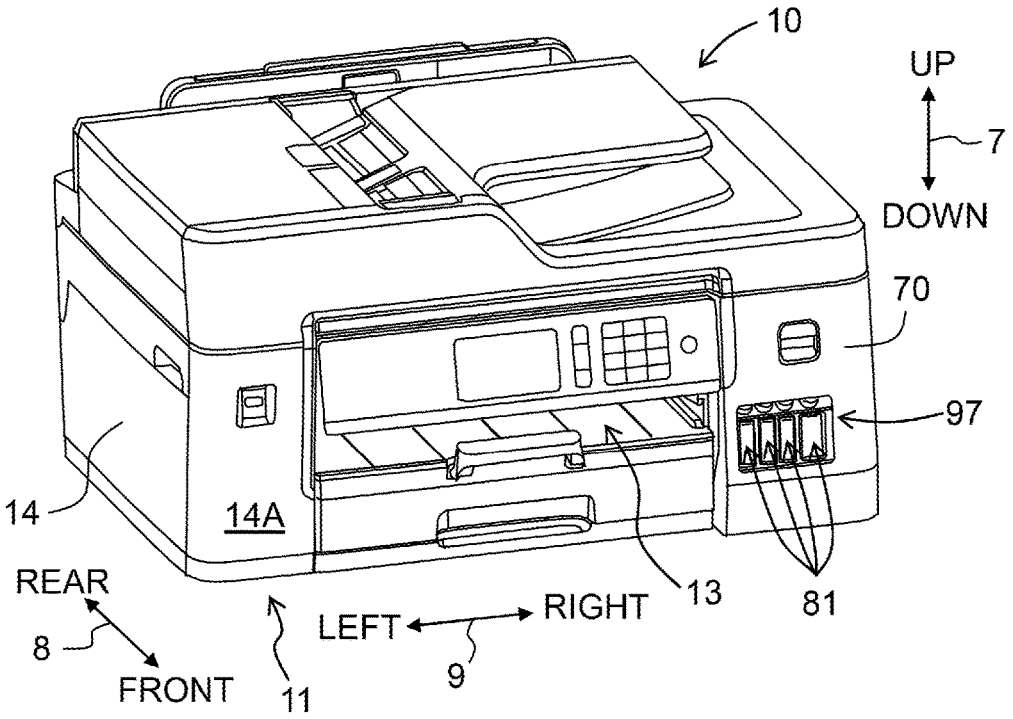

In the following, an embodiment of the present teaching will be explained, with reference to the drawings as appropriate. Note that, however, the embodiment explained below is merely an example of the present teaching; it goes without saying that it is possible, for example, to make any appropriate change(s) in the embodiment of the present teaching without departing from the gist and/or scope of the present teaching. As depicted in FIG. 1, a posture in which the multi-function peripheral 10 and an ink tank 100 arranged in the multi-function peripheral 10 are usably installed in a horizontal plane will be referred to as a "usable posture" in the following explanation. An up-down direction 7 is defined with the "usable posture" as the reference. Further, a front-rear direction 8 (an example of a second direction) is defined, with a side on which an opening 13 of the multi-function peripheral 10 is provided is designated as the frontward side (front surface or front side), and a left-right direction 9 (an example of a first direction) is defined as viewing the multi-function peripheral 10 from the frontward side (front surface). In the embodiment, the up-down direction 7 corresponds to the vertical direction, and each of the front-rear direction 8 and the left-right direction 9 corresponds to the horizontal direction in the usable posture. The front-rear direction 8 and the left-right direction 9 are orthogonal to each other.

<Overall Configuration of Multi-Function Peripheral 10>

Figure 1B:
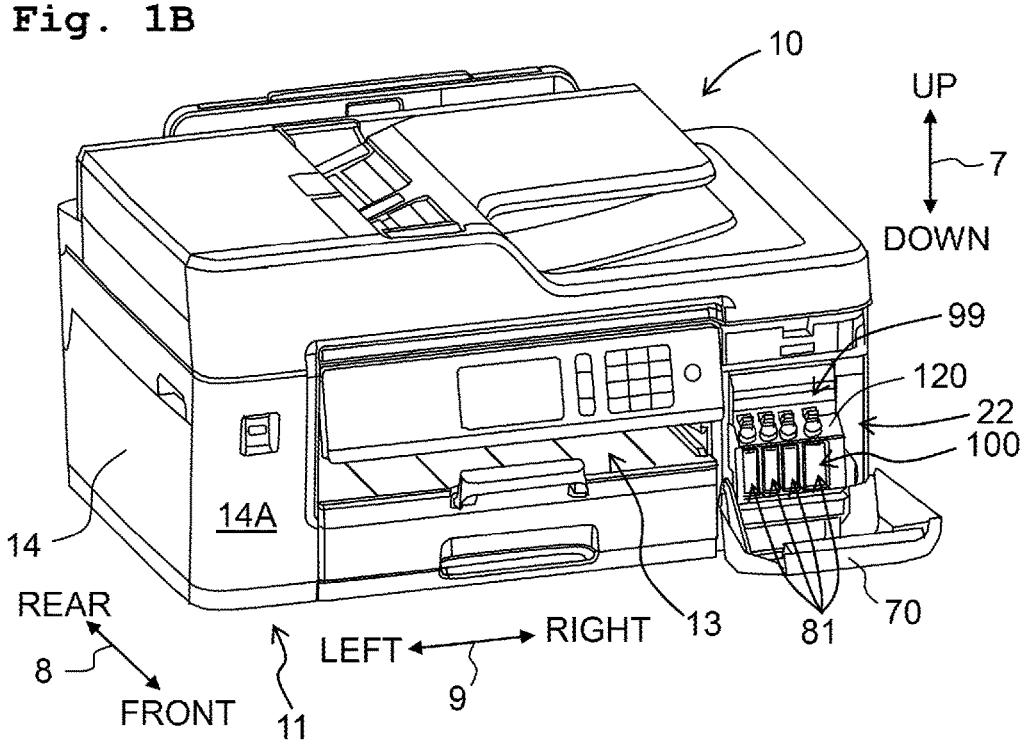
Figure 2:
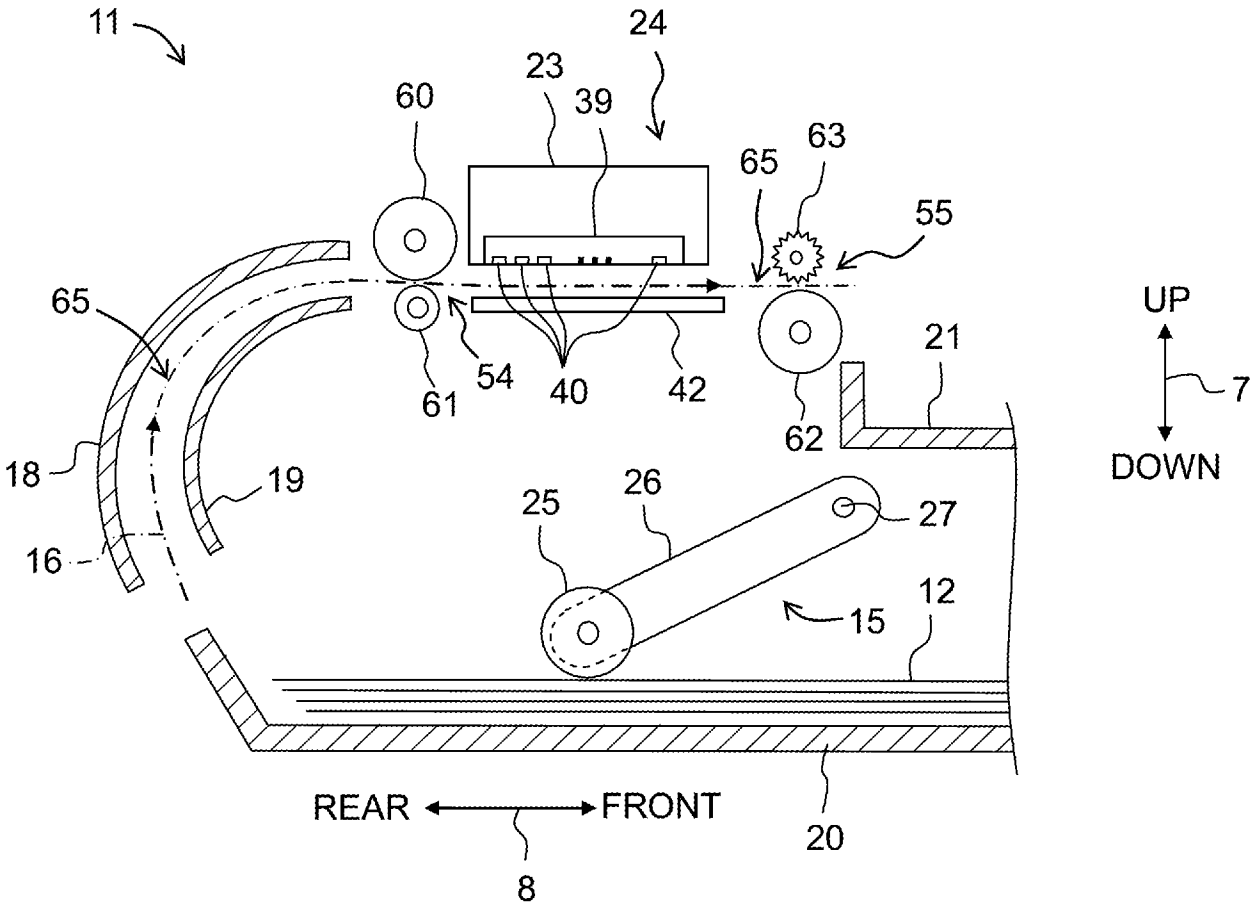
FIG. 2 is a vertical cross-sectional view schematically depicting the internal structure of a printer unit 11.

As depicted in FIGS. 1A and 1B, the multi-function peripheral 10 (an example of a liquid consuming apparatus) is formed to have a substantially rectangular parallelepiped shape. The multi-function peripheral 10 includes, at a lower portion of the multi-function peripheral 10, a printer unit 11 which records an image onto a paper 12 (sheet 12, paper sheet 12; see FIG. 2) by an ink-jet recording method. The printer unit 11 has a casing 14 including a front wall 14A and an opening 13 formed in the front wall 14A. As depicted in FIG. 2, a feeding section 15, a feed tray 20, a discharge tray 21, a conveyance roller section 54, a recording section 24, a discharge roller section 55, a platen 42, and a tank set 99 (see FIG. 1B) are arranged in the inside of the casing 14. Further, the multi-function peripheral 10 has various functions such as a facsimile function, a print function, etc. Note that the state depicted in FIGS. 1A and 1B is the usable posture of the multi-function peripheral 10.

<Feed tray 20, Discharge Tray 21>

As depicted in FIGS. 1A and 1B, the feed tray 20 is inserted into or removed from the multi-function peripheral 10 by a user, in the front-rear direction 8 through the opening 13. The opening 13 is positioned in a location, of the front surface of the multi-function peripheral 10, which is in the center in the left-right direction 9 of the front surface. The feed tray 20 is capable of supporting a plurality of sheets of the paper 12 that are stacked in the feed tray 20, as depicted in FIG. 2. The discharge tray 21 is arranged at a position at the upper side of (above) the feed tray 20. The discharge tray 21 supports the paper 12 discharged by the discharge roller section 55.

<Feeding Section 15>

The feeding section 15 feeds the paper 12 supported by the feed tray 20 to a conveyance route 65 (to be described later on). As depicted in FIG. 2, the feeding section 15 includes a feeding roller 25, a feeding arm 26, and a shaft 27. The feeding roller 25 is rotatably supported by the feeding arm 26 at a front end thereof. The feeding roller 25 rotates in a direction for causing the paper 12 to be conveyed in a conveyance direction 16 by a driving force applied to the feeding roller 25 from a conveyance motor (not depicted in the drawings). The feeding arm 26 is pivotably supported by the shaft 27 supported by a frame of the printer unit 11. A bias is applied to the feeding arm 26 by an elastic force of a spring, etc., or by the self-weight of the feeding arm 26 such that the feeding arm 26 is pivoted and urged toward the feed tray 20.

<Conveyance Route 65>

Figure 3:
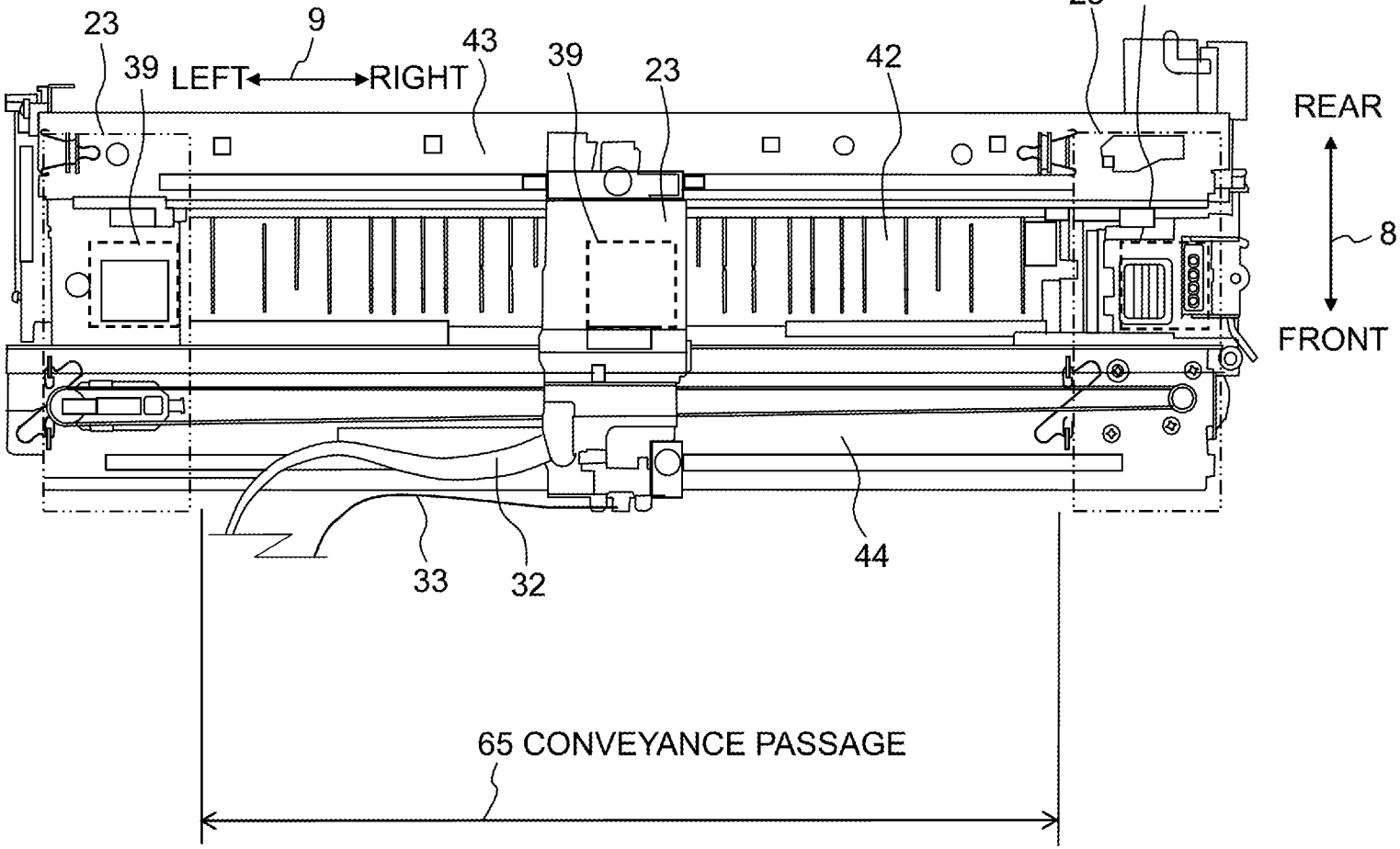
FIG. 3 is a plane view depicting the arrangement of a carriage 23 and a platen 42.

As depicted in FIG. 2, the conveyance route 65 is a route or path which extends from a rear-end portion of the feed tray 20 rearwardly toward the rear side of the printer unit 11. A portion of the conveyance route 65 is defined, in the interior of the printer unit 11, by an outer guide member 18 and an inner guide member 19 which are arranged to face with each other with a predetermined gap intervened therebetween. The conveyance route 65 makes a U-turn frontwardly while extending from the lower side to the upper side, at the rear side of the printer unit 11; and then the conveyance route 65 reaches the discharge tray 21 via a space between the recording section 24 and the platen 42. As depicted in FIGS. 2 and 3, a portion of the conveyance route 65 between the conveyance roller section 54 and the discharge roller section 55 is provided at a substantially central portion in the left-right direction 9 of the multi-function peripheral 10, and extends in the front-rear direction 8. In FIG. 2, the conveyance direction 16 of the paper 12 in the conveyance route 65 is indicated by an arrow of a dot-dash chain line.

<Conveyance Roller Section 54>

As depicted in FIG. 2, the conveyance roller section 54 is arranged in the conveyance route 65 at the upstream side of the recording section 24 in the conveyance direction 16 in the conveyance route 65. The conveyance roller section 54 includes a conveyance roller 60 and a pinch roller 61 which are facing each other. The conveyance roller 60 is driven by the conveyance motor. The pinch roller 61 rotates following the rotation of the conveyance roller 60. The paper 12 is conveyed in the conveyance direction 16 by being pinched between the conveyance roller 60 and the pinch roller 61 which are rotated normally (positively) by the normal rotation of the conveyance motor.

<Discharge Roller Section 55>

As depicted in FIG. 2, the discharge roller section 55 is arranged at a location, in the conveyance route 65, which is on the downstream side of the conveyance roller section 54 in the conveyance direction 16. The discharge roller section 55 includes a discharge roller 62 and a spur 63 which are facing each other. The discharge roller 62 is driven by the conveyance motor. The spur 63 rotates following the rotation of the discharge roller 62. The paper 12 is conveyed in the conveyance direction 16 by being pinched between the discharge roller 62 and the spur 63, with the discharge roller 62 being rotated by a driving force transmitted to the discharge roller 62 from the conveyance motor.

<Recording Section 24>

As depicted in FIG. 2, the recording section 24 is arranged between the conveyance roller section 54 and the discharge roller section 55 in the conveyance direction 16. The recording section 24 is arranged to face the platen 42, while sandwiching the conveyance route 65 therebetween, in the up-down direction 7. The recording section 24 includes a carriage 23 and a recording head 39.

As depicted in FIG. 3, the carriage 23 is supported by guide rails 43 and 44 which are extended respectively in the left-right direction 9, at positions separated respectively in the front-rear direction 8. The guide rails 43 and 44 are supported by the frame of the printer unit 11. The carriage 23 is connected to a known belt mechanism disposed on the guide rail 44. The belt mechanism is driven by a carriage motor (not depicted in the drawings). The carriage 23 connected to the belt mechanism reciprocates in the left-right direction 9 by being driven by the carriage motor. The moving range of the carriage 23 expands or reaches to locations apart from the conveyance route 65 toward left and right sides, as depicted by a dot-dash chain line of FIG. 3.

As depicted in FIG. 3, an ink tube 32 and a flexible flat cable 33 are extended from the carriage 23.

The ink tube 32 connects each of ink tanks 100 (an example of a tank; see FIG. 1B) of the tank set 99 to the recording head 39. The ink tube 32 supplies an ink (an example of a liquid) stored in each of the ink tanks 100 of (constructing) the tank set 99 to the recording head 39. More specifically, four ink tubes 32 (which are collectively referred to also as the "ink tube(s) 32" in some cases) via which four kinds of inks (black, magenta, cyan and yellow inks) are flowed or distributed respectively are provided corresponding to four ink tanks 100, respectively, and are connected to the carriage 23 in a bundled form.

The flexible flat cable 33 electrically connects the recording head 39 to a control circuit board having a controller (not depicted in the drawings) mounted thereon. The flexible flat cable 33 transmits a control signal outputted from the controller to the recording head 39.

As depicted in FIG. 2, the recording head 39 is installed on the carriage 23. A plurality of nozzles 40 is arranged (formed) in the lower surface of the recording head 39. End portions (forward end or tip portions) of the nozzles 40 are exposed from the lower surface of the recording head 39 and from the lower surface of the carriage 23 on which the recording head 39 is installed. The recording head 39 jets or discharges the ink as fine ink droplets (minute ink droplets) through the nozzles 40. In a process of movement of the carriage 23, the recording head 39 jets the ink droplets toward the paper 12 supported by the platen 42. Accordingly, an image, etc. is recorded on the paper 12. Further, by this jetting of the ink droplets, the ink stored in the ink tanks 100 is consumed.

<Platen 42>

As depicted in FIGS. 2 and 3, the platen 42 is arranged between the conveyance roller section 54 and the discharge roller section 55 in the conveyance direction 16. The platen 42 is arranged so as to face the recording section 24 in the up-down direction 7 with the conveyance route 65 being interposed therebetween. The platen 42 supports the paper 12, conveyed by the conveyance roller section 54, from therebelow.

<Cover 70>

As depicted in FIG. 1B, an opening 22 is formed in a right portion of the front wall 14A of the casing 14. A cover 70 is attached to the casing 14 such that the cover 70 covers the opening 22 (see FIG. 1A). As depicted in FIGS. 1A and 1B, the cover 70 is pivotable (rotatable) between a closed position at which the cover 70 covers the opening 22 (the position as depicted in FIG. 1A), and an opened position at which the cover 70 is opened to thereby allow the opening 22 to be exposed to the outside of the multi-function peripheral 10 and at which the cover 70 does not cover the opening 22 (the position as depicted in FIG. 1B). An opening 97 is formed in the cover 70.

A space expands in a portion, in the inside of the casing 14, which is located on the rear side (behind) the opening 22. The tank set 99 is arranged or placed in this space in a stationary manner. In a case that the cover 70 is at the closed position, a part or portion of each of the ink tanks 100 and a part or portion of a holding member 120 (to be described below) are visible from the outside thereof, via the opening 97. Note that the opening 97 may be covered by a film having translucency or transparency to a light, under a condition that a part or portion of each of the ink tanks 100 and a part or portion of the holding member 120 are visible from the outside.

<Tank Set 99>

Figure 4:
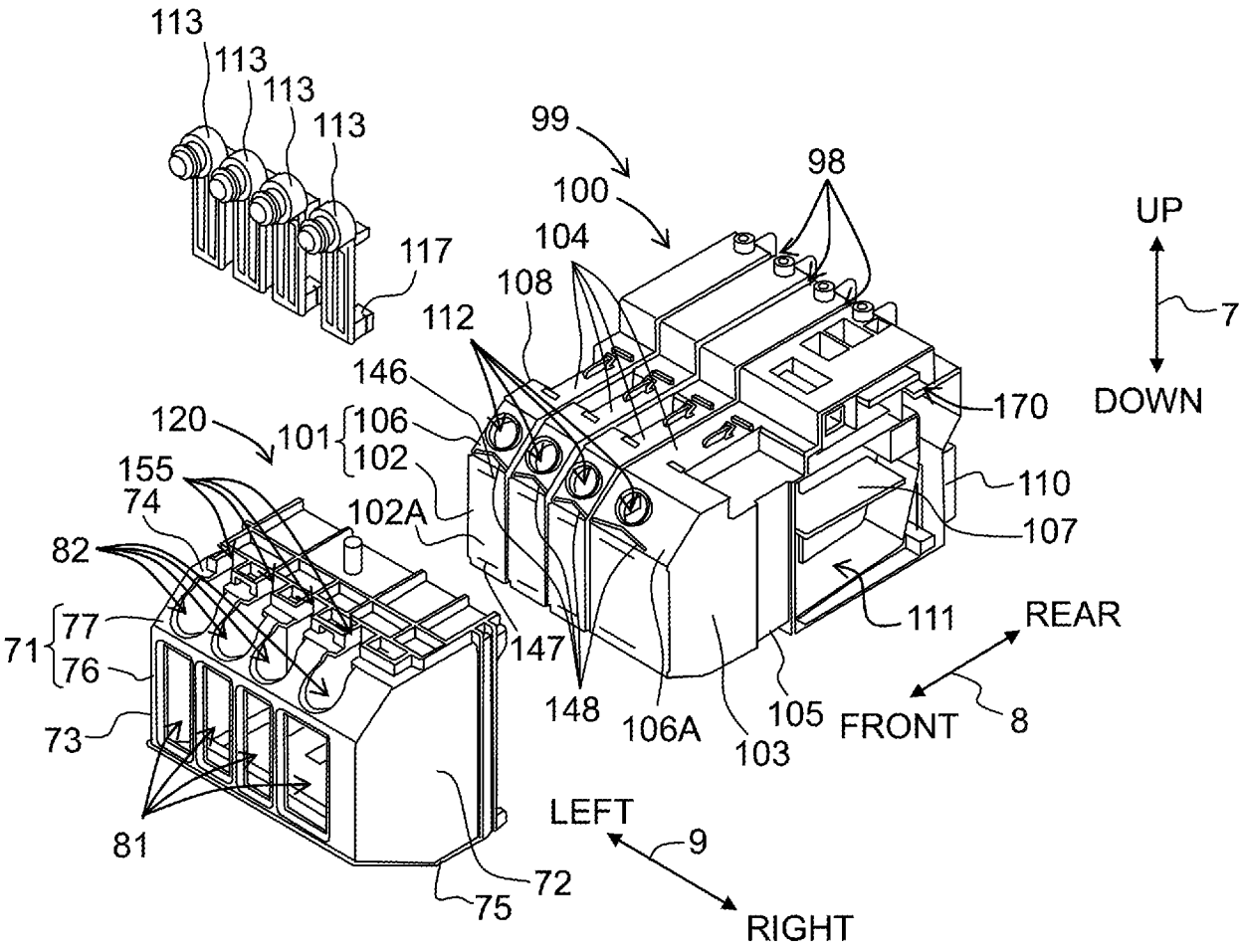
FIG. 4 is a front exploded perspective view of a tank set 99.
Figure 5:
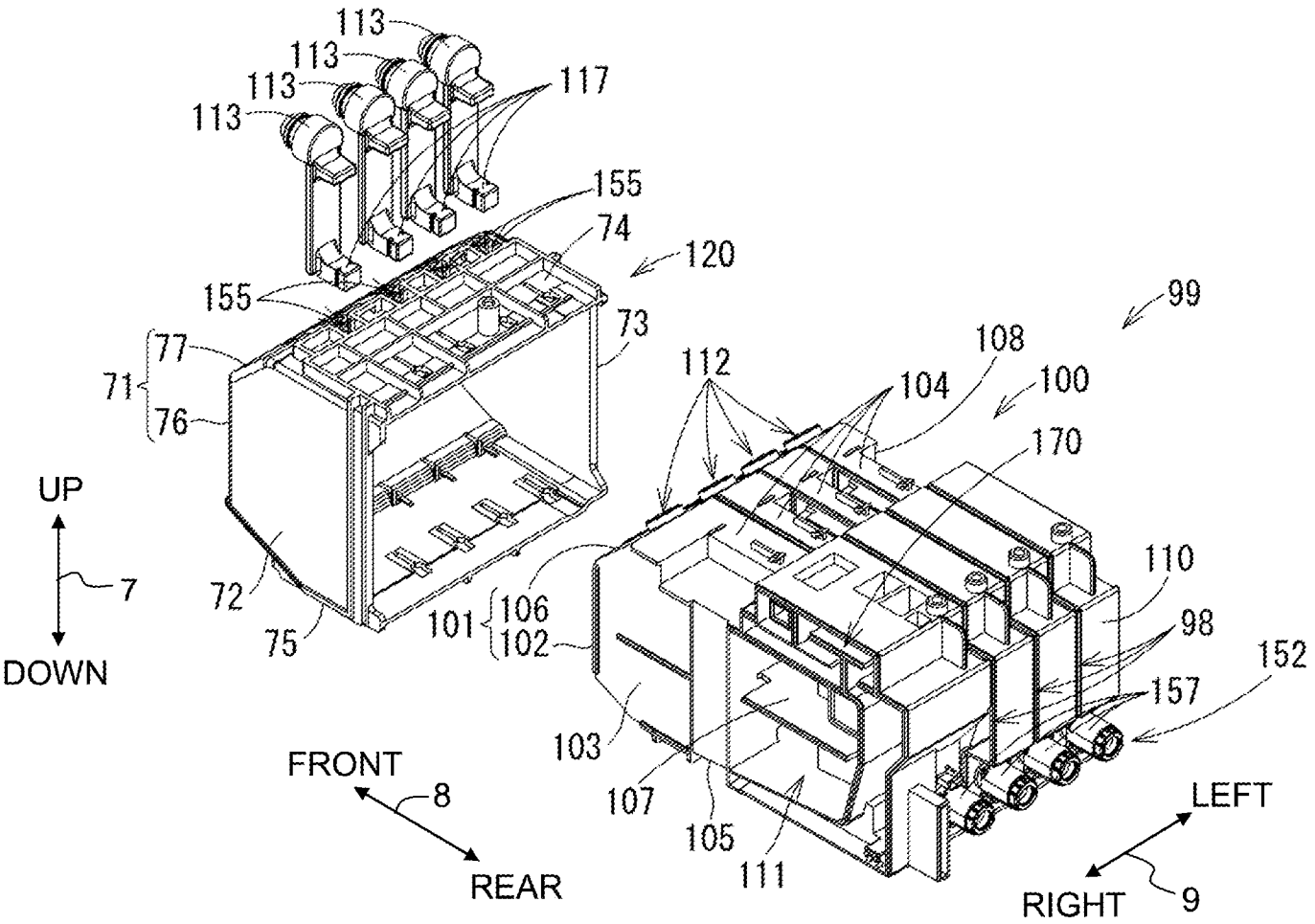
FIG. 5 is a rear exploded perspective view of the tank set 99.

The tank set 99 is configured to store the inks to be supplied to the recording head 39. As depicted in FIGS. 4 and 5, the tank set 99 is provided with four ink tanks 100 storing inks of different colors, respectively, and a holding member 120.

The holding member 120 is configured to hold the four ink tanks 100 in a state that the ink tanks 100 are arranged in a row along the left-right direction 9. Note that in FIGS. 4 and 5, an ink tank 100, among the four ink tanks 100, which is arranged at the right end is capable of storing the ink in a volume greater than that in the remaining three ink tanks 100 included in the four ink tanks 100. However, in the present teaching, there is no particular limitation in the magnitude relationship among the sizes of the four ink tanks 100.

<Ink Tank 100>

Figure 6:
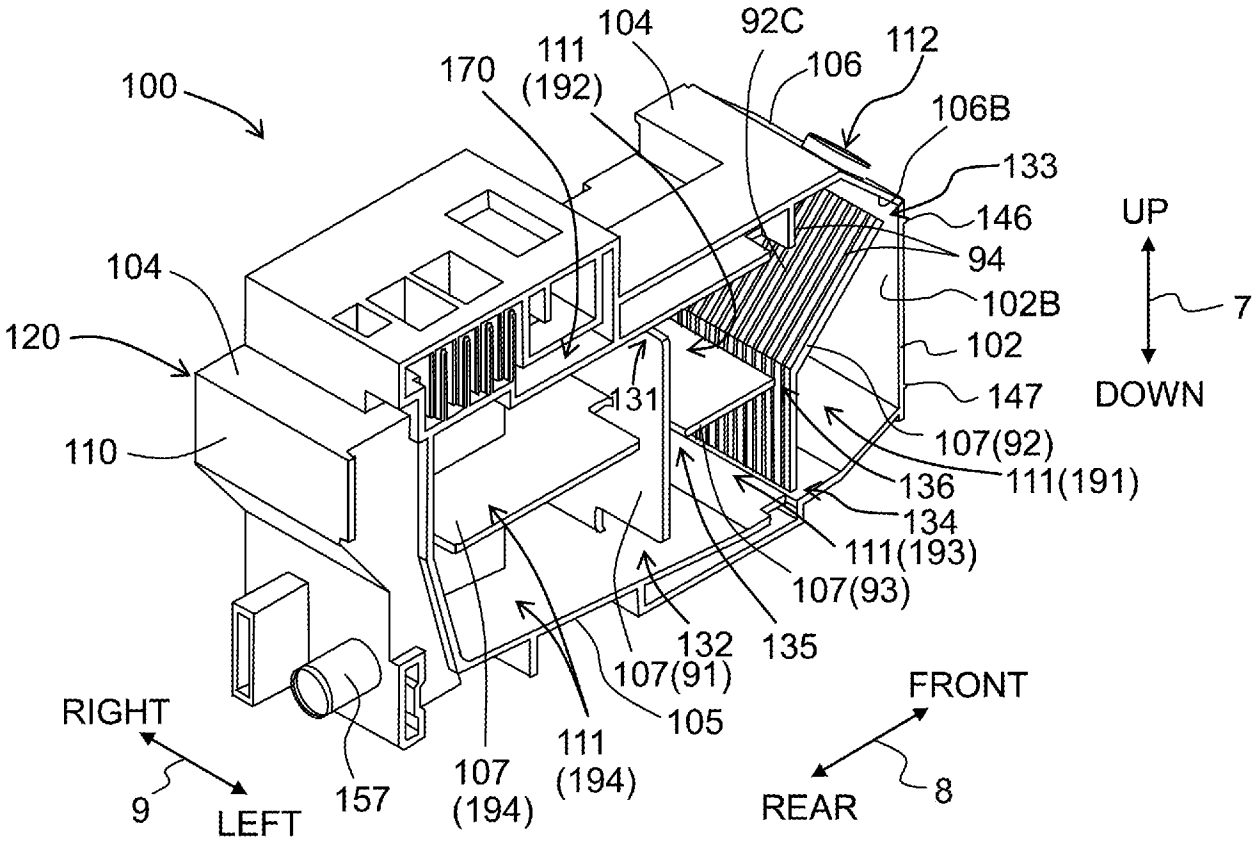
FIG. 6 is a rear perspective view of an ink tank 100.

As depicted in FIGS. 4 to 6, each of the ink tanks 100 has a shape that is flat, rectangular parallelepiped. The ink tank 100 has, as a whole, such a shape wherein a size along the left-right direction 9 is short, and sizes along the up-down direction 7 and the front-rear direction 8, respectively, are longer than the size in the left-right direction 9. Further, the size in the front-rear direction 8 is longer than the size in the up-down direction 7. Note that in FIGS. 4 to 6, although a lateral-surface of the ink tank 100 is open, the opened lateral-surface is sealed by a film (not depicted in the drawings). The opened lateral-surface of the ink tank is sealed, for example, by the film, for example, by welding, adhesion, etc. of the film with respect to the opened lateral-surface.

The ink tank 100 is formed of a resin which has a transparency or translucency to light to such an extent that an ink inside an ink chamber 111 (an example of a liquid storing chamber; to be described later on) can be visible from the outside of the ink tank 100. The ink tank 100 is provided with a front wall 101, a right wall 103, a left wall 108, an upper wall 104, a lower wall 105 (an example of a third wall), a rear wall 110, and a partition wall 107. The ink chamber 111 and an atmosphere communicating channel 170 (to be described later on) are constructed of the front wall 101, the right wall 103, the left wall 108, the upper wall 104, the lower wall 105, the rear wall 110 and the partition wall 107.

Note that in the present embodiment, in the ink tank 100 included in the four ink tanks 100 and arranged at the rightmost side, a front portion of a right lateral-surface thereof is constructed of the right wall 103, and a rear portion of the right lateral-surface and a left lateral-surface thereof are constructed of the film. On the other hand, in each of the remaining three ink tanks 100 included in the four ink tanks 100, a front portion of a left lateral-surface thereof is constructed of the left wall 108, and a rear portion of the left lateral-surface and a right lateral-surface thereof are constructed of the film.

The right lateral-surface and the left lateral-surface of each of the ink tanks 100 extend rearwardly from both left and right ends, respectively, of the front wall 101. The right lateral-surface and the left lateral-surface of each of the ink tanks 100 expand in the front-rear direction 8 and the up-down direction 7. The right lateral-surface of each of the ink tanks 100 constructs a right surface of the ink chamber 111. The left lateral-surface of each of the ink tanks 100 constructs a left surface of the ink chamber 111. The right lateral-surface and the left lateral-surface of each of the ink tank 100 are facing each other in the left-right direction 9. The right lateral-surface and the left lateral-surface of each of the ink tanks 100 are an example of facing lateral-surfaces.

The front wall 101 constructs the front surface of the ink chamber 111.

The front wall 101 is constructed of a standing wall 102 (an example of a first wall), and an inclined wall 106 (an example of a second wall). The standing wall 102 expands in the up-down direction 7 and the left-right direction 9. The inclined wall 106 is a wall which connects an upper end of the standing wall 102 and a front end of the upper wall 104, and which is formed such that the inclined wall 106 is located above the standing wall 102. The inclined wall 106 is inclined from the upper end of the standing wall 102 such that the inclined wall 106 is oriented more (progressively) upward as approaching to the rear side with respect to the upper end of the upper wall 102. Namely, the inclined wall 106 is oriented more upward as separating farther from the standing wall 102.

A front surface 102A of the standing wall 102 and a front surface 106A of the inclined wall 106 in each of the ink tanks 100 are exposed to the outside of the multi-function peripheral 10 via the opening 97 of the cover 70 (see FIG. 1A) and an opening 81 (see FIGS. 1A and 1B) of the holding member 120. This configuration allows the front surface of each of the ink tanks 100 to be visible (visually confirmable) from a location in front of the multi-function peripheral 10, and allow the user to visually confirm an ink remaining amount of the ink stored in each of the ink tanks 100.

The rear wall 110 faces the front wall 101 in the front-rear direction 8. The rear wall 110 constructs the rear surface of the ink chamber 111.

The right wall 103 is a wall extending rearwardly from a right end of the front wall 101. An upper end of the right wall 103 is connected to a front portion of the upper wall 104. A lower end of the right wall 103 is connected to a front portion of the lower wall 105. The right wall 103 constructs the right surface of the ink chamber 111.

The left wall 108 is a wall extending rearwardly from a left end of the front wall 101. An upper end of the left wall 108 is connected to the front portion of the upper wall 104. A lower end of the left wall 108 is connected to the front portion of the lower wall 105. The left wall 108 constructs the left surface of the ink chamber 111.

The upper wall 104 extends rearwardly from an upper end of the front wall 101 (a rear end of the inclined wall 106). In the ink tank 100 located on the rightmost side among the four ink tanks 100, a front portion of the upper wall 104 of the rightmost ink tank 100 is connected to an upper end of the right wall 103. The upper wall 104 of each of the remaining three ink tanks 100 among the four ink tanks 100 is connected to an upper end of the left wall 108. The upper wall 104 constructs an upper surface of the ink chamber 111.

The lower wall 105 is a wall which extends rearwardly from a lower end of the front wall 101. The lower wall 105 is formed to be away from the upper wall 104 to be positioned below the upper wall 104 in the up-down direction 7. The lower wall 105 constructs a lower surface of the ink chamber 111. Namely, the lower wall 105 defines the bottom of the ink chamber 111.

The partition wall 107 is provided as a plurality of partition walls 107 which are arranged in a space surrounded by the front wall 101, the right wall 103, the upper wall 104, the lower wall 105 and the rear wall 110. Namely, the plurality of partition walls 107 are arranged inside the ink chamber 111.

A projection 157 (see FIGS. 5 and 6) projects rearwardly from the rear wall 110. Namely, the projection 157 (see FIGS. 5 and 6) projects toward the outer side of each of the ink tanks 100. The projection 157 is formed to be hollow. The internal space of the projection 157 is communicated with the ink chamber 111. The projection 157 is connected to the ink tube 32 (see FIG. 3) directly or indirectly. With this, the ink entering from the ink chamber 111 into the internal space of the projection 157 is allowed to flow out to the ink tube 32.

The ink tank 100 has an atmosphere communicating channel 170. The atmosphere communicating channel 170 is a communication channel for communicating the ink chamber 111 with the outside of the ink tank 100.

A supply port 112 via which the ink is supplied to the ink chamber 111 is formed in the inclined wall 106 of the ink tank 100. The supply port 112 penetrates the inclined wall 106 in a thickness direction thereof, and allows the ink chamber 111 to communicate with the outside of the ink tank 100. By positioning the cover 70 at the opened position, the inclined wall 106 and the supply port 112 are exposed to the outside of the multi-function peripheral 10 via the opening 22 (see FIG. 1B). By arranging the supply port 112 in the inclined wall 106, the ink can be supplemented easily to the ink chamber 111 from a location obliquely above the ink tank 100 via the supply port 112.

Figure 7:
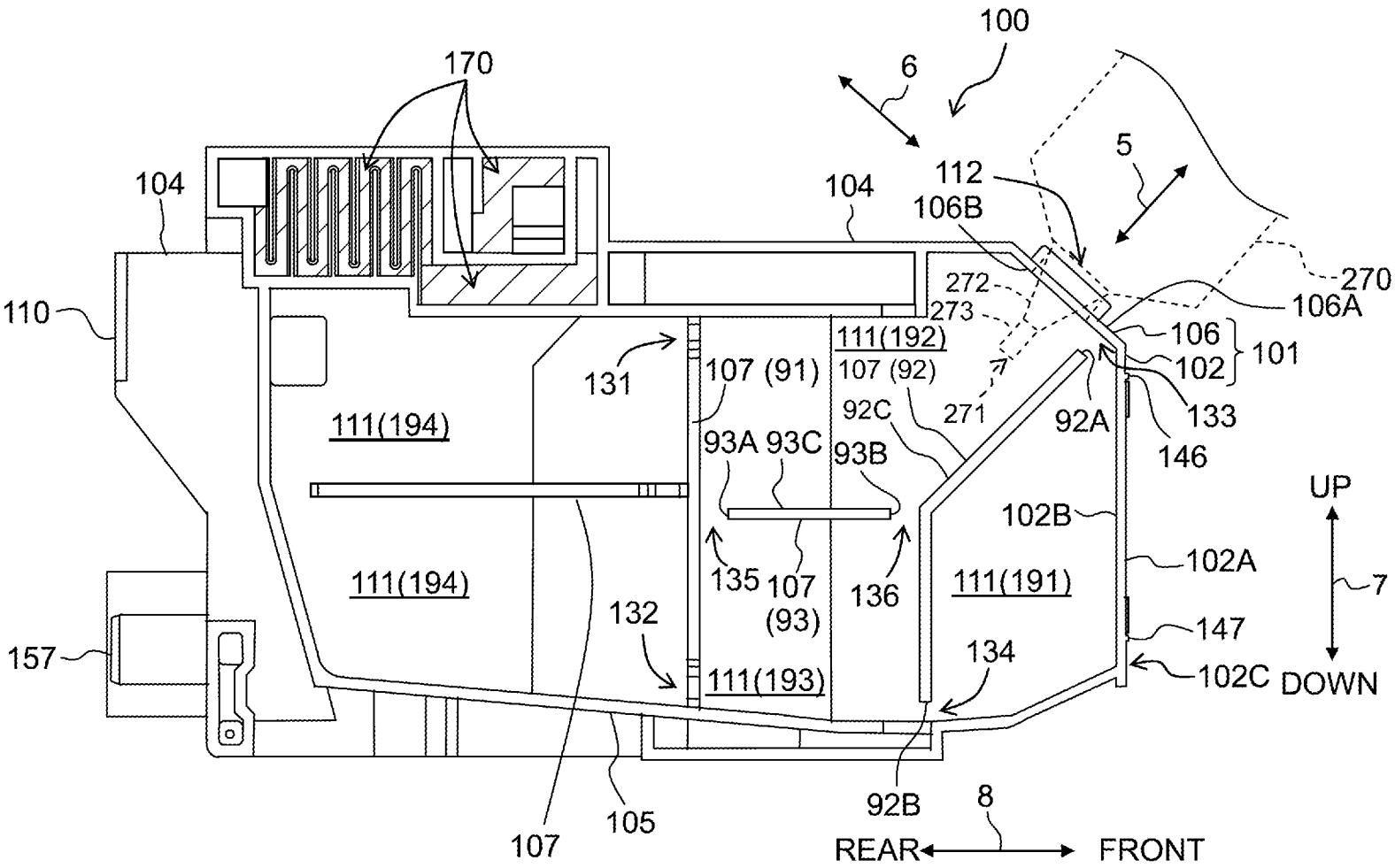
FIG. 7 is a left side view of the ink tank 100.

As depicted in FIG. 7, in a case that the ink in the inside of the ink chamber 111 of each of the ink tanks 100 is used up (ends), the ink is supplemented (replenished) to the ink chamber 111 by the user from a bottle 270 storing the ink therein. In FIG. 7, the bottle 270 is depicted with broken lines. The bottle 270 has a shape which is a substantially cylindrical tube, and includes an inlet port 271, a tapered part 272 of which diameter is decreased progressively (is tapered) toward the inlet port 271, and a nozzle part 273 extending from the tapered part 272.

As depicted in FIG. 4, the front surface 102A of the standing wall 102 of the front wall 101 is provided with a first line 146 and a second line 147. The first line 146 and the second line 147 are scales configured to indicate a reference with respect to an ink amount of the ink stored in the ink chamber 111.

The first line 146 extends in the left-right direction 9. Under a condition that a maximum amount of the ink storable in the ink chamber 111 is stored in the ink chamber 111 and that the multi-function peripheral 10 is in the usable posture, the position in the up-down direction 7 of the first line 146 is at a height which is same as the liquid surface of the maximum amount of the ink. Namely, the first line 146 is located at a position corresponding to the liquid surface of the ink in a case that the maximum amount of the ink is stored in the ink chamber 111. In other words, the first line 146 indicates the upper limit of the ink amount storable in the ink chamber 111.

The second line 147 extends in the left-right direction 9. The second line 147 is located below the first line 146 in the up-down direction 7. Specifically, under a condition that an amount which is smaller than the maximum amount of the ink is stored in the ink chamber 111 and that the multi-function peripheral 10 is in the usable posture, the position in the up-down direction 7 of the second line 147 is at a height which is same as the liquid surface of the amount of the ink which is smaller than the maximum amount. In the embodiment, the position in the up-down direction 7 of the second line 147 is at a height same as the liquid surface of an amount of the ink, which requires supplement of the ink, is stored in the ink chamber 111 under the condition that the multi-function peripheral 10 is in the usable posture. Namely, the second line 147 is located at a position corresponding to the liquid surface of the ink in a case that the amount of the ink stored in the ink chamber 111 is a minimum storing amount. In other words, the second line 147 indicates the lower limit of the ink amount stored in the ink chamber 111.

As indicated in FIG. 4, the inclined wall 106 of the front wall 101 is provided with a rib 148 projecting from the front surface 106. Note that in the drawings which are different from FIG. 4 and in which the inclined wall 106 is depicted, the illustration of the rib 148 is omitted.

The rib 148 is formed at a position below the supply port 112. The rib 148 extends substantially in the left-right direction 9 from the vicinity of the right end to the vicinity of the left end of the front surface 106A. Specifically, the rib 148 is inclined more downward toward the right side from a central portion in the left-right direction 9 of the rib 148 and is inclined more downward toward the left side from the central portion in the left-right direction 9 of the rib 148.

By forming the rib 148 in the front surface 106A of the inclined wall 106, even in a case that the ink is poured into the ink chamber 111 via the supply port 112 and that the ink leaks from the supply port 112, the rib 148 prevents the leaked ink from adhering to a location, in the front surface 102A of the standing wall 102, which is below the first line 146. Further, since the rib 148 is inclined, the ink adhered to the rib 148 from thereabove is guided along the rib 148 to the outside in the left-right direction 9 of the ink tank 100. With these, since the possibility that the ink might adhere to the standing wall 102 can be lowered, it is possible to achieve an effect of lowering the possibility that the visual confirmation of the ink inside the ink chamber 111 from the outside of the ink tank 100 via the standing wall 102 might be hindered due to any adhered ink.

Note that the shape of the rib 148 is not limited to the shape as depicted in FIG. 4, under a condition that the above-described effect can be achieved. For example, the rib 148 can be shorter in the left-right direction 9 than that depicted in FIG. 4. In such a case, the rib 148 preferably extends from a location on the right side with respect to the first and second lines 146 and 147 up to a location on the left side with respect to the first and second lines 146 and 147. Alternatively, for example, the rib 148 may extend straight along the left-right direction 9, may be inclined downward from the left end more toward the right end, or may be inclined downward from the right end more toward the left end.

Further, the position of the rib 148 is not limited to the position as depicted in FIG. 4, under a condition that the above-described effect can be achieved. For example, the rib 148 may be formed in the standing wall 102, rather than in the inclined wall 106, or may be formed over both of the inclined wall 106 and the standing wall 102. In such a case, the rib 148 is preferably formed at a position above the first line 146.

<Partition Walls 91, 92 and 93>

As depicted in FIGS. 6 and 7, the plurality of partition walls 107 include a partition wall 91 (an example of a fifth wall), a partition wall 92 (an example of a fourth wall) and a partition wall 93 (an example of a sixth wall).

The partition wall 91 faces the standing wall 102 in the front-rear direction 8 with the partition wall 92 being sandwiched between the partition wall 91 and the standing wall 102. The partition wall 91 is a wall expanding in a direction having a component in the up-down direction 7 and in a direction having a component in the left-right direction 9. In this embodiment, the partition wall 91 expands in the up-down direction 7 and the left-right direction 9.

The partition wall 92 is located between the front wall 101 and the partition wall 91 in the front-rear direction 8. The partition wall 92 is a wall expanding in a direction having a component in the up-down direction 7 and in a direction having a component in the left-right direction 9.

In the present embodiment, an upper part of the partition wall 92 is inclined progressively downward toward the rear side (as approaching to the rear side with respect to the standing wall 102). Namely, the upper part of the partition wall 92 is inclined more downward as separating farther from the standing wall 102. The upper part of the partition wall 92 extends parallel to a direction 5 which is orthogonal to a rear surface 106B of the inclined wall 106. The upper part of the partition wall 92 expands in the direction 5 and in the left-right direction 9. A lower part of the partition wall 92 extends downwardly from the lower end of the upper part of the partition wall 92. The lower part of the partition wall 92 expands in the up-down direction 7 and in the left-right direction 9.

The partition wall 93 is located between the partition wall 92 and the partition wall 91 in the front-rear direction 8. The partition wall 93 extends in the front-rear direction 8 from the partition wall 92 toward the partition wall 91. The partition wall 92 is a wall expanding in a direction having a component in the front-rear direction 8 and in a direction having a component in the left-right direction 9. In the present embodiment, the partition wall 93 expands in the front-rear direction 8 and in the left-right direction 9.

An entire area of the right end of each of the partition walls 91, 92 and 93 is connected to the right lateral-surface of the ink tank 100. An entire area of the left end of each of the partition walls 91, 92 and 93 is connected to the left lateral-surface of the ink tank 100.

Note that it is allowable that only a part of the right end of each of the partition walls 91, 92 and 93 is connected to the right lateral-surface of the ink tank 100, and/or that only a part of the left end of each of the partition walls 91, 92 and 93 is connected to the left lateral-surface of the ink tank 100. For example, it is allowable that only upper ends of the partition walls 91 and 92 are connected to the right lateral-surface and the left lateral-surface of the ink tank 100, and/or that only a front end of the partition wall 93 is connected to the right lateral-surface and the left lateral-surface of the ink tank 100. Alternatively, it is allowable that the right end of each of the partition walls 91, 92 and 93 is not connected to the right lateral-surface of the ink tank 100, and/or that the left end of each of the partition walls 91, 92 and 93 is not connected to the left lateral-surface of the ink tank 100.

The ink chamber 111 is divided into a first chamber 191, a second chamber 192, a third chamber 193 and a fourth chamber 194 by the partition wall 91, the partition wall 92 and the partition wall 93.

A gap 131 is formed (defined) between the upper end of the partition wall 91 and the upper wall 104. A gap 132 is formed between the lower end of the partition wall 91 and the lower wall 105. The second chamber 192 and the fourth chamber 194 are communicated with each other by the gap 131. The third chamber 193 and the fourth chamber 194 are communicated with each other by the gap 132.

A gap 133 (an example of a first gap is formed between the front wall 101 and an upper end 92A (an example of a first end), in the partition wall 92, which is located closely to the front wall 101. The gap 133 is formed over an entire area in the left-right direction 9 of the upper end 92A. Note that the gap 133 may be formed only in a part in the left-right direction 9 (for example, only in a right end) of the upper end 92A.

The upper end 92A of the partition wall 92 is located above the first line 146. Further, the upper end 92A of the partition wall 92 is located below the supply port 112. Namely, an upper end part (upper end 92A and a portion surrounding or in the vicinity of the upper end 92A) of the partition wall 92, as a part of the partition wall 92, is located, in the up-down direction 7, between the first line 146 and the supply port 112.

The upper end 92A of the partition wall 92 is located between the supply port 112 and the standing wall 102, in a direction 6 along the rear surface 106B of the inclined wall 106. Namely, the upper end part of the partition wall 92 is located at a position closer to the standing wall 102 than to the supply port 112.

A gap 134 (an example of a second gap) is formed between the lower wall 105 and a lower end 92B (an example of a second end), in the partition wall 92, which is located closely to the lower wall 105. The gap 134 is formed over an entire area in the left-right direction 9 of the lower end 92B. Note that the gap 134 may be formed only in a part in the left-right direction 9 (for example, only in a right end part) of the lower end 92B.

The lower end 92B of the partition wall 92 is located below a lower end 102C of the standing wall 102. Note that the lower end 92B of the partition wall 92 may be located above the lower end 102C of the standing wall 102. In this case, the lower end 92B of the partition wall 92 may be located below the second line 147. Of course, the lower end 92B of the partition wall 92 may be located above the second line 147.

As depicted in FIG. 6, a plurality of grooves 94 are formed in a surface 92C (an example of a facing surface), of the partition wall 92, which is oriented toward the second chamber 192 and the third chamber 193. Here, the supply port 112 is oriented toward the second chamber 192 of the partition wall 92. Namely, the surface 92C is oriented toward the second chamber 192, that is a space, in the ink chamber 111, to which the supply port 112 faces.

Each of the plurality of grooves 94 extends, from the upper end 92A up to the lower end 92B of the partition wall 92, in a direction orthogonal to the left-right direction 9 and along the surface 92C. The plurality of grooves 94 are formed to be arranged side by side to one another with a spacing distance therebetween in the left-right direction 9.

Note that the number of the grooves 94, the spacing distance between adjacent grooves 94 which are included in the plurality of grooves 94 and which are adjacent to each other in the left-right direction 9, a direction in which each of the grooves 94 extends, and the depth of each of the grooves 94 are not limited to or restricted by those as depicted in FIG. 6, and may be set as appropriate. Further note that it is not necessarily indispensable that the grooves 94 extend from the upper end 92A up to the lower end 92B of the partition wall 92. Furthermore, the grooves 94 may be present or absent, as appropriate.

As depicted in FIG. 7, a gap 135 (an example of a third gap) is formed between the partition wall 91 and a rear end 93A (an example of a third end), in the partition wall 93, which is arranged closely to the partition wall 91. The gap 135 is formed over an entire area in the left-right direction 9 of the rear end 93A. Note that the gap 135 may be formed only in a part in the left-right direction 9 (for example, only in a right end part) of the rear end 93A. Alternatively, the gap 135 may be omitted. Namely, the partition wall 93 may be connected to the partition wall 91.

As depicted in FIG. 7, a gap 136 (an example of a fourth gap) is formed between the partition wall 92 and a front end 93B (an example of a fourth end), in the partition wall 93, which is arranged closely to the partition wall 92. The gap 136 is formed over an entire area in the left-right direction 9 of the front end 93B. Note that the gap 136 may be formed only in a part in the left-right direction 9 (for example, only in a right end part) of the front end 93B. Alternatively, the gap 136 may be omitted. Namely, the partition wall 93 may be connected to the partition wall 92.

<Holding Member 120>

As depicted in FIGS. 4 and 5, the holding member 120 is configured to hold the four ink tanks 100 from the front side thereof, in a state that the four ink tanks 100 are arranged in a row along the left-right direction 9, while positioning the ink tanks 100 with respect to the holding member 120. The holding member 120 is provided with a front wall 71, a right wall 72, a left wall 73, an upper wall 74 and a lower wall 75. The front wall 71 is constructed of a standing wall 76 and an inclined wall 77. The standing wall 76 expands in the up-down direction 7 and the left-right direction 9. The inclined wall 77 is a wall connecting an upper end of the standing wall 76 and a front end of the upper wall 74. The inclined wall 77 is inclined with respect to the up-down direction 7 and the front-rear direction 8.

The right wall 72 is a wall extending rearwardly from a right end of the front wall 71. The left wall 73 is a wall extending rearwardly from a left end of the front wall 71. The upper wall 74 is a wall extending rearwardly from an upper end of the front wall 71 (specifically, from an upper end of the inclined wall 77). A right end of the upper wall 74 is connected to an upper end of the right wall 72. A left end of the upper wall 74 is connected to an upper end of the left wall 73. The lower wall 75 is a wall extending rearwardly from a lower end of the front wall 71. A right end of the lower wall 75 is connected to a lower end of the right wall 72. A left end of the lower wall 75 is connected to a lower end of the left wall 73.

In a state that the four ink tanks 100 are positioned in the left-right direction 9 relative to the holding member 120, a gap 98 is formed between adjacent ink tanks 100 which are adjacent to each other among the four ink tanks 100. The holding member 120 covers front parts (front portions) of the ink tanks 100, in a state that the holding member 120 holds the ink tanks 100.

A plurality of openings 81 are formed in the standing wall 76 of the front wall 71 of the holding member 120. The respective openings 81 are formed with a spacing distance therebetween in the left-right direction 9. In the present embodiment, the openings 81 are formed to correspond to the four ink tanks 100, respectively. The number of the opening 81 is set based on the number of the ink tank 100 held by the holding member 120. Further, although the shape of each of the openings 81 in the embodiment is rectangular, each of the openings 81 may have a shape different from the rectangular shape.

In a state that the holding member 120 holds the respective ink tanks 100, the standing wall 102 of the front wall 101 of each of the ink tanks 100 can be exposed to the outside of the holding member 120 via one of the openings 81. Specifically, the front surface 102A of the standing wall 102 and the first line 146 and the second line 147 which are formed in the front surface 102A can be exposed to the outside of the holding member 120. Further, in the state that the holding member 120 holds the respective ink tanks 100 and in the state that the cover 70 is at the closed position, the standing wall 102 of each of the ink tanks 100 can be exposed to the outside of the printer section 11 via one of the openings 81 of the holding member 120 and via the opening 97 (see FIG. 1A) of the cover 70.

A plurality of openings 82 are formed in the inclined wall 77 of the front wall 71 of the holding member 120. The respective openings 82 are formed with a spacing distance therebetween in the left-right direction 9. In the present embodiment, the openings 82 are formed to correspond to the four ink tanks 100, respectively. Note that the number of the opening 82 is set based on the number of the ink tank 100 held by the holding member 120. Further, although the shape of each of the openings 82 in the embodiment is circular, each of the openings 82 may have a shape different from the circular shape. In the state that the holding member 120 holds the respective ink tanks 100, the supply port 112 of each of the ink tanks 100 can be exposed to the outside of the holding member 120 via one of the openings 82.

Caps 113 are attached to a front portion of the upper wall 74 of the holding member 120. Each of the caps 113 is formed of an elastically deformable material such as rubber, elastomer, etc. The caps 113 are attached to the holding member 120 by engagement or fitting of cap attachment parts 155 formed in the upper wall 74 with respect to attachment parts 117 formed in the caps 113, respectively.

Each of the caps 113 is capable of sealing the supply port 112 of one of the tanks 100 in a fluid-tight manner in a case that a forward end (tip end) part of each of the caps 113 is fitted into the supply port 112 in a state that the caps 113 are attached to the holding member 120 (see FIG. 1B). Further, by separating the forward end of each of the caps 113 from the supply port 112, the supply port 112 is opened (released). As a result, it is possible to supply the ink into the ink chamber 111 via the supply port 112.

<Supply of Ink to Ink Tank 100>

In a case that the ink is supplied to the ink tank 100, the bottle 270 is inserted into the supply port 112 such that the nozzle part 273 is located in the second chamber 192, as depicted in FIG. 7.

Next, the lateral-surface of the bottle 270 is pushed or pressed by the user, thereby allowing the ink stored in the bottle 270 to be released from the nozzle part 273 into the second chamber 192.

In a case that the ink is released with force from the nozzle 273, the released ink passes beyond the partition wall 92 and collides against an upper surface 93C of the partition wall 93. In this situation, since the ink collides against the upper surface 93C of the partition wall 93 from a location in front of and obliquely above the upper surface 93C, a major portion of the collided ink is thereby scattered (flipped) rearwardly and obliquely thereabove. Afterwards, the major portion of the ink collided against the upper surface 93C ink is moved from the second chamber 192 to the third chamber 193 via the gap 135, and a remaining portion of the ink collided against the upper surface 93C is moved from the second chamber 192 to the third chamber 193 via the gap 136.

On the other hand, in a case that the force of the release of the ink from the nozzle part 273 is weak, the released ink collides against the surface 92C of the partition wall 92. In this situation, since the force of the release of the ink from the nozzle part 273 is weak, a major portion of the collided ink flows downwardly along the grooves 94 formed in the surface 92C, without being scattered (flipped). Further, a portion of the collided ink is scatted (flipped). In this situation, since the ink collides against the surface 92C, of the partition wall 92, which is inclined rearwardly and obliquely downwardly, from a location above the surface 92C, the major portion of the collided ink is scatted (flipped) rearwardly. Afterward, the major portion of the ink collided against the surface 92C is moved from the second chamber 192 to the third chamber 193 via the gap 136, and a remaining portion of the ink collided against the surface 92C is moved from the second chamber 192 to the third chamber 193 via the gap 135.

In a case that the ink is continuously supplied from the bottle 270, the amount of the ink stored in the third chamber 193 becomes great, which in turn raises the liquid surface of the ink to be high. Accordingly, the ink is moved from the third chamber 193 to the fourth chamber 194 via the gap 132. In addition, the ink is moved from the third chamber 193 to the first chamber 191 via the gap 134.

In a case that the newly supplied ink collides against the liquid surface of the ink stored in the third chamber 193 from thereabove, the ink is ruffled (waved). Further, under a condition that the liquid surface of the ink is located in the second chamber 192 due to the raised liquid surface of the ink and that the newly supplied ink collides against the liquid surface from thereabove, the ink is ruffled (waved). The ruffled ink in the third chamber 193 and in the second chamber 192 is moved in the frontward and rearward directions. The entering of the ink moving frontwardly into the first chamber 191 is lowered by the partition wall 92; the entering of the ink moving rearwardly into the fourth chamber 194 is lowered by the partition wall 91.

According to the above-described embodiment, in a case that the ink is supplied to the ink chamber 111 from the supply port 112, the major portion of the ink entered into the ink chamber 111 from the supply port 112 is not firstly located in the first chamber 191, in the ink chamber 111, which is sandwiched between the standing wall 102 and the partition wall 92; rather, the major portion of the ink entered into the ink chamber 111 from the supply port 112 is firstly located in the second chamber 192 and in the third chamber 193, in the ink chamber 111, each of which is located on the opposite side to the standing wall 102 relative to the partition wall 92. Then, the ink enters, via the gap 134, from the third chamber 193 into the first chamber 191 from a lower side of the first chamber 191.

In a case that the ink enters into the second chamber 192 and to the third chamber 193 from the supply port 112 and that the ink falls on the liquid surface of the ink already stored in each of the second and third chambers 192 and 193, the liquid surface is waved. In the above-described embodiment, since the partition wall 92 extends toward the lower wall 105, it is possible to reduce, by the partition wall 92, the reaching of the wave generated in the liquid surface to (at) the first chamber 191. As a result, it is possible to reduce the reaching of the wave, generated in the inside of the ink tank 100 when the ink is supplemented to the ink tank 100, to the standing wall 102.

The gap 133 allows the air to circulate between the first chamber 191 and the second chamber 192. Accordingly, even in such a case that the liquid surface of the ink supplied to the ink chamber 111 is raised to thereby fill the gap 134 with the ink, the ink can be further supplied to the first chamber 191.

Provided that the gap 133 is formed (defined) only at the right end portion of the upper end 92A of the partition wall 92, and that the ink tank 100 is placed in such an inclined state that the right end portion of the upper end 92A is located below the left end portion of the upper end 92A of the partition wall 92, there is such a fear that the air might accumulate at the left end portion. In a case that the accumulation of air occurs when the ink is supplied to the ink tank 100, an amount of the ink stored in the ink chamber 111 is reduced. In the above-described embodiment, since the gap 133 is formed over the entire area in the left-right direction 9 of the upper end 92A of the partition wall 92, the accumulation or air can be avoided.

According to the above-described embodiment, the gap 134 is located below the standing wall 102. Accordingly, even if the wave generated in the third chamber 193 enters into the first chamber 191 via the gap 134, it is possible to reduce the reaching of the wave to (at) the standing wall 102.

According to the above-described embodiment, both the right end and the left end of the partition wall 92 are connected to the right lateral-surface and the left end surface, respectively, of the ink tank 100. Accordingly, it is possible to suppress the entering of the wave generated in the second chamber 192 and the third chamber 193 into the first chamber 191.

According to the above-described embodiment, the upper end of the partition wall 92 is located at a position between the first line 146 and the supply port 112 in the up-down direction 7. Further, the upper end of the partition wall 92 is located at a position closer to the standing wall 102 than to the supply port 112. Accordingly, it is possible to reduce any entering of the ink, supplied to the second chamber 192 from the supply port 112, into the first chamber 119 from the gap 133.

According to the above-described embodiment, the ink entered into the second chamber 192 from the supply port 112 circulates to the third chamber 193 via the gap 135 arranged at a position apart from the standing wall 102, and then the ink circulates into the first chamber 191 via the gap 134. Namely, the wave of the liquid surface of the ink stored in the third chamber 193 is generated at a position apart from the standing wall 102. With this, the amplitude of the wave becomes small before the wave is advanced closely to the standing wall 102. As a result, it is possible to reduce any adhesion of the waved ink to a location, in the inner surface of the standing wall 102, which is positioned above the actual liquid surface of the ink.

Provided that the gap 135 is formed only at the right end portion of the rear end 93A of the partition wall 93, and that the ink tank 100 is placed in such an inclined state that the right end portion of the rear end 93A is located below the left end portion of the rear end 93A of the partition wall 93, there is such a fear that the air might accumulate at the left end portion. In a case that the accumulation of air occurs when the ink is supplied to the ink tank 100, an amount of the ink stored in the ink chamber 111 is reduced. In the above-described embodiment, since the gap 135 is formed over the entire area in the left-right direction 9 of the rear end 93A of the partition wall 93, the accumulation or air can be avoided.

Provided that the gap 136 is not formed, and that the ink tank 100 is placed in such an inclined state that the rear end 93A of the partition wall 93 is located below the front end 93B of the partition wall 93, there is such a fear that the air might accumulate at the front end 93B of the partition wall 93. In a case that the accumulation of air occurs when the ink is supplied to the ink tank 100, an amount of the ink stored in the ink chamber 111 is reduced. In the above-described embodiment, since the gap 136 is formed, the accumulation or air can be avoided.

Further, in a case that the force of the ink entering into the second chamber 192 from the supply port 112 is weak, the ink falls onto the partition wall 92 and is guided downwardly along the partition wall 92. Provided that the gap 136 is not formed, the ink is guided from the partition wall 92 to the partition wall 93, and is guided downwardly via the gap 135. On the other hand, since the gap 136 is formed in the above-described embodiment, the ink is guided downwardly via the gap 136, without being guided to the partition wall 93. With this, it is possible to quickly guide the ink downwardly. As a result, it is possible to guide the ink quickly to the first chamber 191 via the gap 134.

On the other hand, in a case that the force of the ink entering into the second chamber 192 from the supply port 112 is strong, the ink moves beyond the gap 136. Provided that the partition wall 93 is not formed, the ink collides against or makes contact with the liquid surface located at a lower portion of the third chamber 193. With this, the liquid surface is ruffled (wave is generated in the liquid surface). However, in the embodiment, the partition wall 93 is formed. Accordingly, the liquid makes contact with the partition wall 93, and thus does not makes contact with the liquid surface located below the partition wall 93. With this, it is possible to reduce the generation of the wave as described above.

Provided that the gap 136 is formed only at the right end portion of the front end 93B of the partition wall 93, and that the ink tank 100 is placed in such an inclined state that the right portion of the front end 93B is located below the left end portion of the front end 93B of the partition wall 93, there is such a fear that the air might accumulate at the left end portion. In a case that the accumulation of air occurs when the ink is supplied to the ink tank 100, an amount of the ink stored in the ink chamber 111 is reduced. In the above-described embodiment, since the gap 136 is formed over the entire area in the left-right direction 9 of the front end 93B of the partition wall 93, the accumulation or air can be avoided.

According to the above-described embodiment, the bottle 270 storing the ink which is to be supplied to the ink tank 100 can be inserted to the supply port 112 obliquely thereabove. In the embodiment, the bottle 270 can be inserted into the supply port 112 more easily than in a configuration wherein the bottle 270 is inserted into the supply port 112 directly thereabove.

According to the above-described embodiment, the upper part of the partition wall 92 is oriented more downward as separating farther from the standing wall 102. Accordingly, it is possible to guide the ink, supplied to the ink chamber 111 from the supply port 112, downwardly along the partition wall 92.

According to the above-described configuration, it is possible to circulate the ink, supplied to the ink chamber 111 from the supply port 112, quickly to a location apart from the supply port 112 along the grooves 94 by the capillarity (capillary action).

Modified Embodiments

In the embodiment, the wall provided with the supply port 112 (the inclined wall 106) continues to the standing wall 102. It is allowable, however, that the wall provided with the supply port 112 does not continue to the standing wall 102. For example, another wall may be arranged between the wall provided with the supply port 112 and the standing wall 102.

Figure 8:
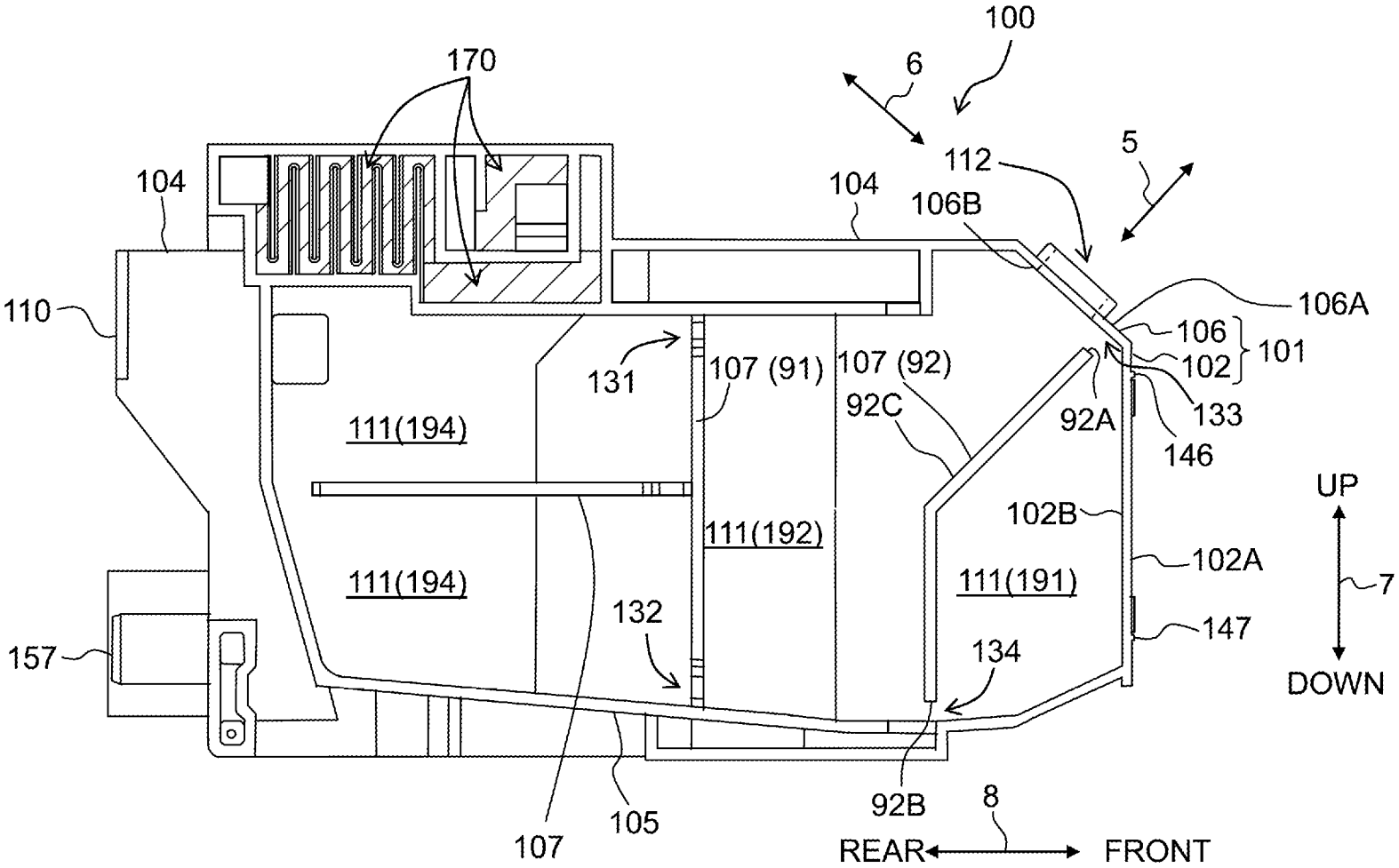
FIG. 8 is a left side view of an ink tank 100 in a modified embodiment.

In the embodiment, the plurality of partition walls 107 include the partition wall 91 and the partition wall 93. However, the presence and absence of the partition walls 91 and 93 is arbitrary. FIG. 8 depicts an ink tank 100 which is provided with the partition wall 91, but is not provided with the partition wall 93. Although not depicted in the drawing, it is allowable that the ink tank 100 is provided with the partition wall 93, but is not provided with the partition wall 91, or that the ink tank 100 is not provided with both the partition wall 91 and the partition wall 93.

In the embodiment, as depicted in FIG. 7, the upper part of the partition wall 92 is inclined progressively downward toward the rear side, and the lower part of the partition wall 92 extends downwardly from the lower end portion of the upper part of the partition wall 92. Namely, the partition wall 92 is bent. However, the direction in which the partition wall 92 extends is not limited to or restricted by this.

For example, the partition wall 92 may be curved.

Alternatively, it is allowable that the partition wall 92 is not bent. For example, as depicted in FIG. 9, the entirety of the partition wall 92 may be inclined progressively downward toward the rear side.

Figure 9:
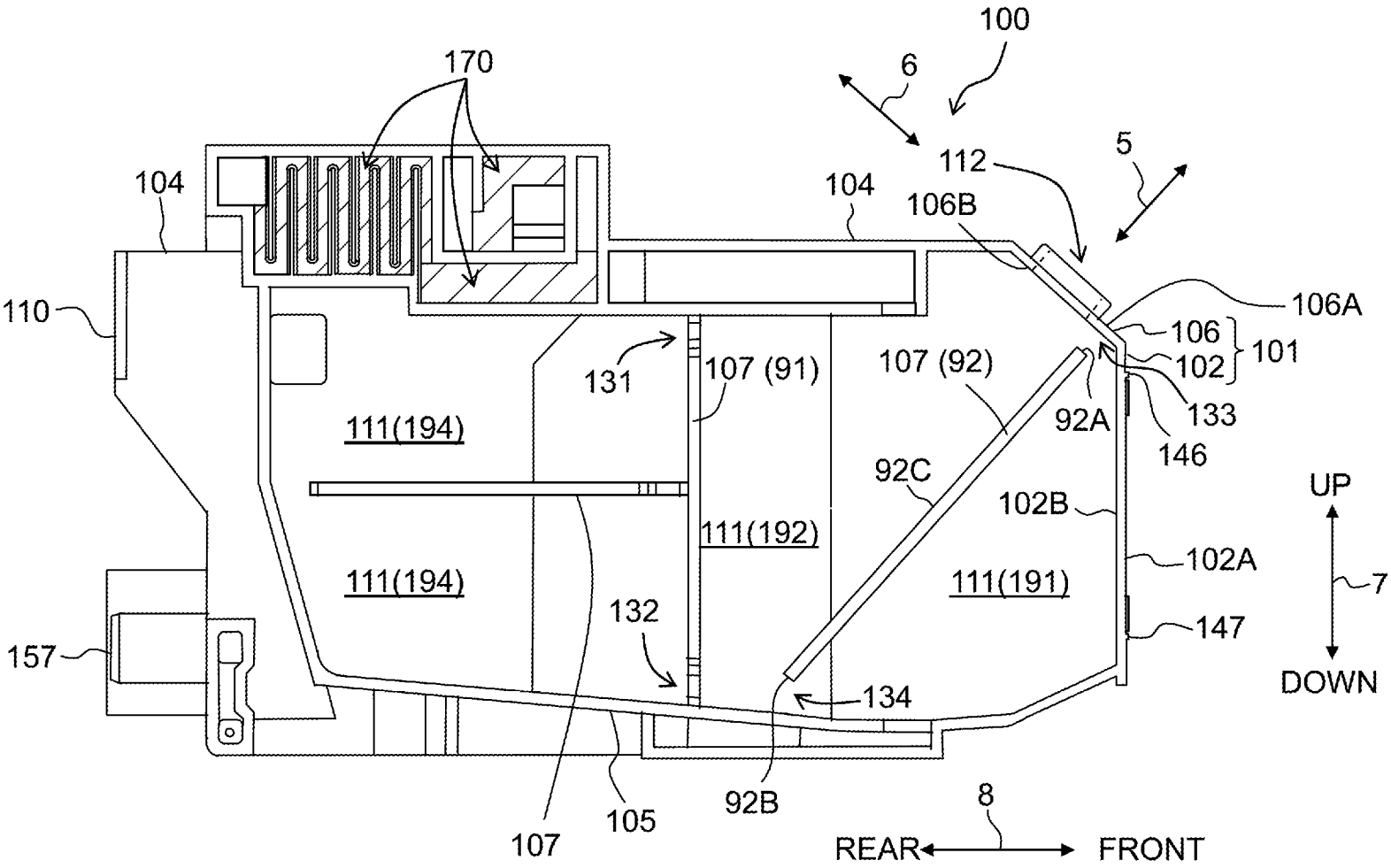
FIG. 9 is a left side view of an ink tank 100 in a modified embodiment.
Figure 10:
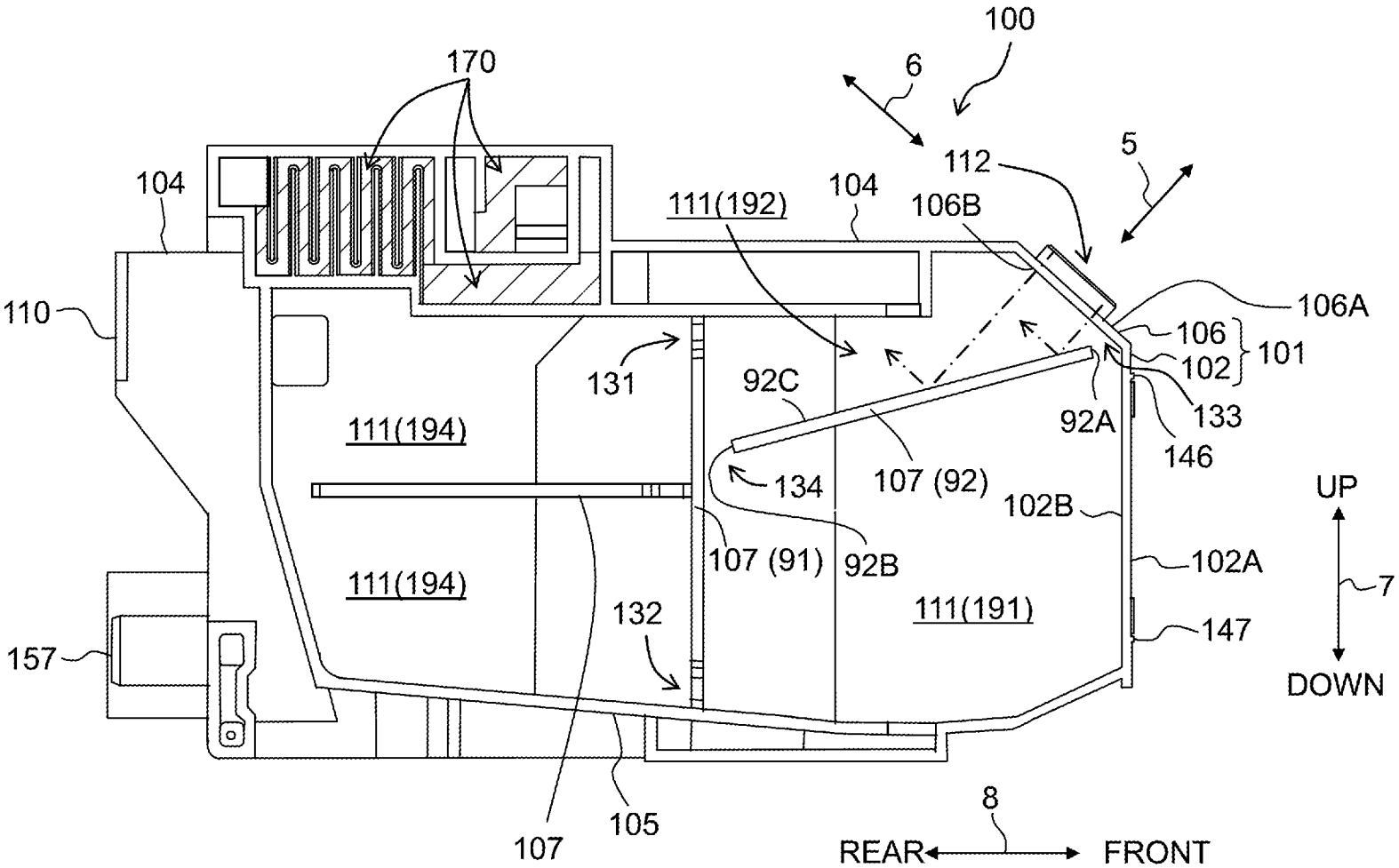
FIG. 10 is a left side view of an ink tank 100 in a modified embodiment.

In FIGS. 7 and 9, although the partition wall 92 extends along the direction 5, it is allowable that the partition wall 92 does not extend along the direction 5. For example, the partition wall 92 may be inclined in a direction crossing the direction 5, as depicted in FIG. 10. Alternatively, for example, it is allowable that the partition wall 92 extends in the front-rear direction 8 (horizontal direction) crossing the direction 5, as depicted in FIG. 11.

The partition wall 92 is preferably arranged such that a reflected virtual column body, of a virtual column body extending in an axial direction 79 of the supply port 112, with the inner surface of the supply port 112 as a cross-section of the virtual column body, and reflected off the partition wall 92, does not reach the supply port 112. An explanation will be given using a light; the partition wall 92 is arranged such that a reflected light (indicated by a dash-dot line in FIGS. 10 and 11) of the light entering from the supply port 112 into the second chamber 192 of the ink chamber 111 along the axial direction of the supply port 112 and reflected off the partition wall 92 does not reach the supply port 112. Note that it is also allowable that the partition wall 92 is arranged such that the reflected light reaches the supply port 112, it is preferred that the partition wall 92 is arranged such that the reflected light does not reach the supply port 112. Note that this dash-dot line corresponds to the lateral-surface of a virtual column body which is extended along the axial direction (the direction 5 in this embodiment), with the inner surface of the supply port 112 as the cross section thereof, and corresponds also to a lateral-surface of the reflected virtual column body reflected off the partition wall 92.

Figure 11:
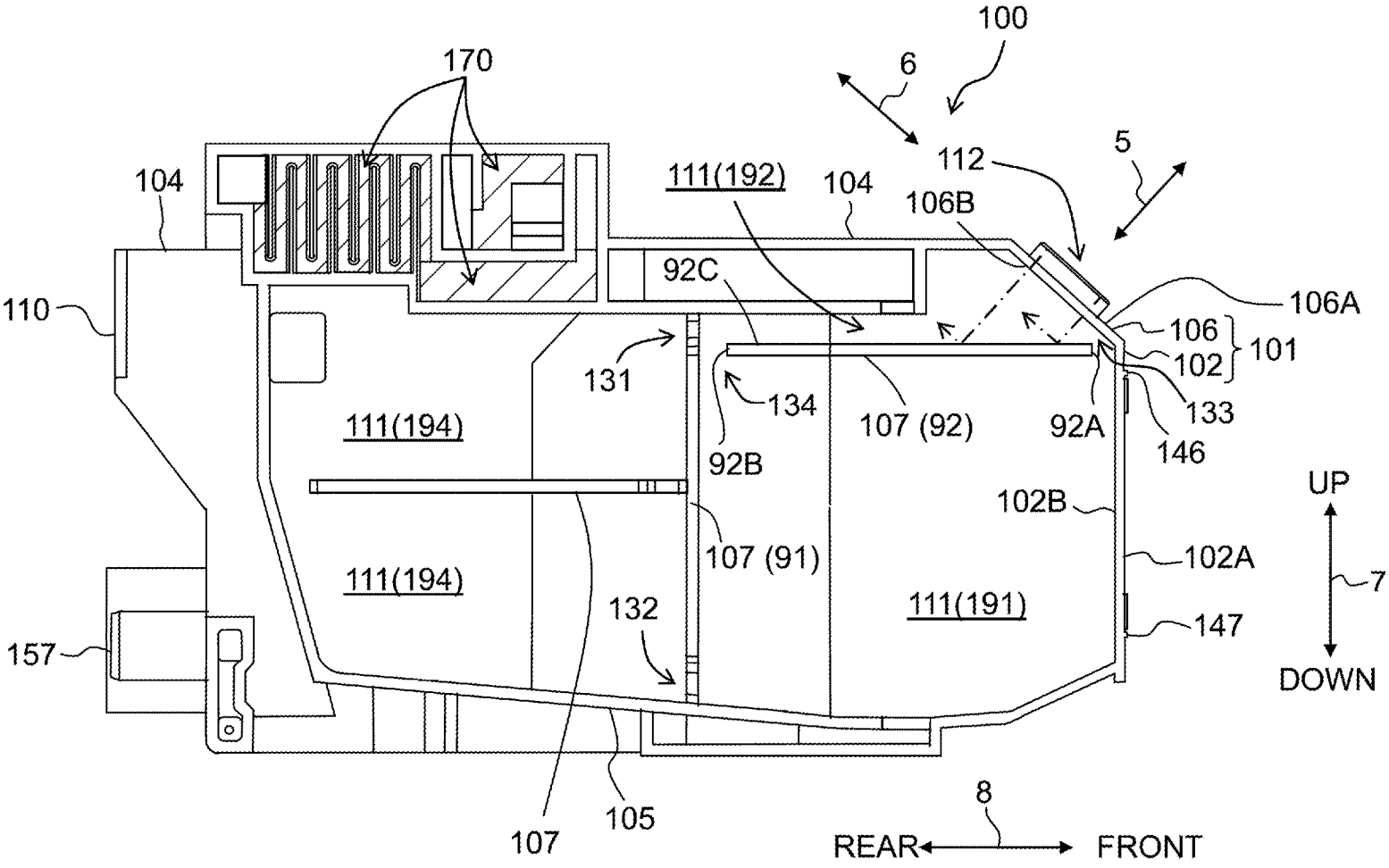
FIG. 11 is a left side view of an ink tank 100 in a modified embodiment.

According to the configurations depicted in FIGS. 10 and 11, respectively, in a case that the ink entering into the ink chamber 111 via the supply port 112 collides against the partition wall 92, the collided ink is less likely to be scattered (flipped) such that the ink is led toward the supply port 112. With this, it is possible to lower any leakage of the ink, entered from the supply port 112 into the second chamber 192, to the outside of the ink tank 100 via the supply port 112.

In the above-described embodiment, the partition wall 93 extends along the front-rear direction 8, as depicted in FIG. 7. However, the direction in which the partition wall 93 extends is not limited to the front-rear direction 8. For example, the partition wall 93 may extend such that the partition wall 93 is oriented progressively downward toward the rear side.

In the embodiment, only the part of the partition wall 92 (the upper part of the partition wall 92) is located between the first line 146 and the supply port 112 in the up-down direction 7. However, in a case that the partition wall 92 extends along the front-rear direction 8 as depicted in FIG. 11, the entirety of the partition wall 92 is located between the first line 146 and the supply port 112 in the up-down direction 7.

In the embodiment, only the upper part of the partition wall 92 is located between the supply port 112 and the standing wall 102 in the direction 6. However, in a case that the entirety of the partition wall 92 extends along the direction 5 as depicted in FIG. 9, the entirety of the partition wall 92 is located between the supply port 112 and the standing wall 102 in the direction 6.

Figure 12:
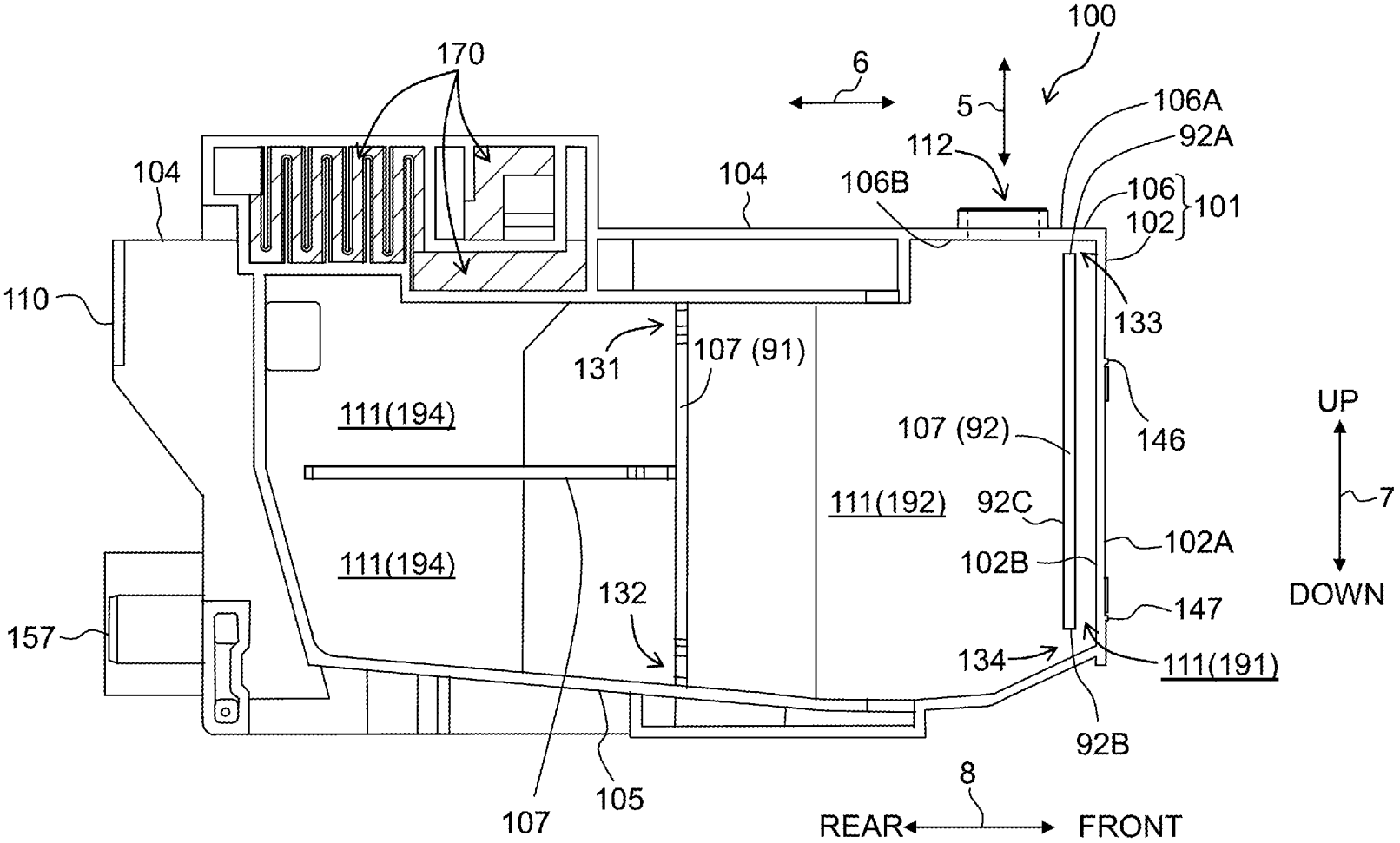
FIG. 12 is a left side view of an ink tank 100 in a modified embodiment.

In the embodiment, the inclined wall 106 is formed between the standing wall 102 and the upper wall 104. However, it is allowable that the ink tank 100 is not provided with the inclined wall 106. For example, as depicted in FIG. 12, it is allowable that the upper end of the standing wall 102 and the front end of the upper wall 104 are connected to each other, and that the supply port 112 is formed in the upper wall 104. In such a case, the upper wall 104 is an example of the second wall.

In the embodiment, the entirety of the ink tank 100 is formed of the resin which has the transparency or translucency to light to such an extent that the ink inside the ink chamber 111 can be visible from the outside of the ink tank 100. It is allowable, however, that in the walls constructing the ink tank 100, the walls different from the standing wall 102 of the front wall 101 may be formed of a member which is different from the resin having the above-described the transparency or translucency to light.

In the embodiment, although the tank set 99 is provided with the holding member 120, it is allowable that the tank set 99 is not provided with the holding member 120. In such a case, the four ink tanks 100 are not integrally held (handled) by the holding member 120, and each of the four ink tanks 100 are individually arranged stationarily in the casing 14.

In the embodiment, the ink is explained as an example of the liquid. However, the present teaching is not limited to this. Namely, instead of being an ink, the liquid may be exemplified by a pre-treatment liquid which is to be jetted (discharged) to a recording sheet (recording paper or recording paper sheet) before the ink is jetted (discharged) during the printing; or the liquid may be exemplified by water, etc., which is to be sprayed in the vicinity of the nozzles 40 of the recording head 39 for the purpose of preventing drying of the nozzles 40 of the recording head 39, and the like.

What is claimed is:

1. A tank comprising:

a liquid storing chamber which is configured to store liquid to be consumed in a liquid consuming apparatus;

a first wall expanding in a horizontal direction and in a direction having a vector component in an up-down direction, the liquid stored in the liquid storing chamber being visible, through the first wall, from outside of the liquid storing chamber;

a second wall including a supply port located above the first wall and being configured to supply the liquid to the liquid storing chamber therethrough;

a third wall defining a bottom of the liquid storing chamber; and a fourth wall arranged in the liquid storing chamber, wherein a first gap is formed between one of the first and second walls and at least a part of a first end in a first direction, of the fourth wall, which is located closely to the one of the first and second walls, the first direction being parallel to the first wall and parallel to the horizontal direction, a second gap is formed between the third wall and at least a part of a second end in the first direction, of the fourth wall, which is located closely to the third wall, and the first gap is formed over an entire area in the first direction of the first end.

2. The tank according to claim 1, wherein the second gap is located below the first wall.

3. The tank according to claim 1, further comprising facing lateral-surfaces which face to each other in the first direction and which expand respectively from both ends in the first direction of the first wall in a second direction crossing the first direction and in the direction having the vector component in the up-down direction; and both end portions in the first direction of the fourth wall are connected, each at least at a part thereof, with one of the facing lateral-surfaces.

4. The tank according to claim 1, wherein at least a part of the fourth wall is located at a position which is above a liquid surface of the liquid in a state that the liquid is stored in the liquid storing chamber in a maximum allowable amount of the liquid storable in the liquid storing chamber, which is below the supply port, and which is closer to the first wall than to the supply port.

5. The tank according to claim 1, wherein the fourth wall is arranged such that a reflected virtual column body, of a virtual column body extending in an axial direction of the supply port, with an inner surface of the supply port as a cross-section of the virtual column body, and reflected off the fourth wall, does not reach the supply port.

6. The tank according to claim 1, further comprising:

a fifth wall arranged to face the first wall in a second direction crossing the first direction, with the fourth wall being sandwiched between the fifth and first walls; and a sixth wall arranged between the fourth wall and the fifth wall, and extending from the fourth wall toward the fifth wall, wherein a third gap is formed between the fifth wall and at least a part of a third end in the first direction, of the sixth wall, which is located closely to the fifth wall.

7. The tank according to claim 6, wherein the third gap is formed over an entire area in the first direction of the third end.

8. The tank according to claim 6, wherein a fourth gap is formed between the fourth wall and at least a part of a fourth end in the first direction, of the sixth wall, which is located closely to the fourth wall.

9. The tank according to claim 8, wherein the fourth gap is formed over an entire area in the first direction of the fourth end.

10. The tank according to claim 1, wherein the second wall is oriented more upward as separating farther from the first wall.

11. The tank according to claim 1, wherein at least a part of the fourth wall is oriented more downward as separating farther from the first wall.

12. The tank according to claim 1, wherein the fourth wall has a facing surface oriented toward a space in the liquid storing chamber to which the supply port faces; and the fourth wall is provided with a plurality of grooves which are formed in the facing surface of the fourth wall with a spacing distance therebetween in the first direction.

* * * * *